US005092403A

United States Patent [19]

Pinheiro

[11] Patent Number: 5,092,403

[45] Date of Patent: Mar. 3, 1992

[54] PACKER CENTRALIZING DEVICE

[75] Inventor: Eliberto E. Pinheiro, Natal, Brazil

[73] Assignee: Petroleo Brasileiro S.A. - Petrobras, Rio de Janeiro, Brazil

[21] Appl. No.: 506,045

[22] Filed: Apr. 9, 1990

[30] Foreign Application Priority Data

Apr. 7, 1989 [BR] Brazil ..... 8901637

[51] Int. Cl.[5] ..... E21B 17/10

[52] U.S. Cl. ..... 166/241.1; 166/179; 175/325.1

[58] Field of Search ..... 166/241, 242, 243, 387, 166/179; 175/325

[56] References Cited

U.S. PATENT DOCUMENTS

| | | | |
|---|---|---|---|
| 2,715,552 | 8/1955 | Lane | 166/241 |
| 2,794,617 | 6/1957 | Yancey | 166/241 |
| 3,419,094 | 12/1968 | Bobo | 175/325 |
| 3,999,618 | 12/1976 | Farris | 175/325 |
| 4,000,549 | 1/1977 | Brumley et al. | 175/325 |
| 4,071,101 | 1/1978 | Ford | 175/325 |
| 4,825,947 | 5/1989 | Mikolajczyk | 166/241 |
| 4,928,762 | 5/1990 | Mamke | 166/192 |

*Primary Examiner*—Terry L. Melius
*Attorney, Agent, or Firm*—Sughrue, Mion, Zinn, Macpeak & Seas

[57] ABSTRACT

This invention concerns a centralizing device for packers intended to be connected to the lower end of a packer and lowered into a producing well, guiding and centralizing said packer within the inside casing, which device consists of a sturdy tubular body (51) provided at its middle with a set of fins (53) which projects outwards from the diameter of said tubular body (51), and divides it (51), that its provided above and below with connecting means (55, 57), at an upper part (59), a middle part (61) surrounded by said set of fins (53), while at a lower part (63) said fins (53) are spaced apart lengthwise and equidistantly, consisting of a longer curved portion (65) of the same outside shape as said tubular body and provided above with straight portions (67) that rise towards the upper part (59) of said tubular body (51) and below with straight portions (69) that drop towards said lower part (63) of such tubular body (51).

3 Claims, 3 Drawing Sheets

PACKER CENTRALIZING DEVICE

FIELD OF THE INVENTION

This invention concerns a centralizing device meant to guide a packer towards the middle of the inside casing of oil production wells. Under this invention the packer does not come into direct touch with the top of the inside casing of the producing well.

BACKGROUND OF THE INVENTION

Those engaged in the art know that a producing well consists of casing inside of which runs a drill string and drill stems and further in, concentrically, a liner, which is the inside casing of the well.

When a packer is lowered to be seated in the producing well, particularly if the well slopes steeply, it is very difficult to guide the packer into the inside casing of the well, since the diameter of the latter is small. To lower the packer without allowing the packer to touch the top of the inside casing, which might not only damage such inside casing top, but also very often the packer itself is provided with outside rubber sealing parts, tends to slow up the lowering of the packer and also raises the cost of such action, owing to such equipment having to be replaced or reconditioned.

Practice has been to employ various kinds of centralizers, all of them meant to be employed within the actual casing. Such state of the art packers are, for instance, provided with pairs of collar-like parts spaced axially apart, usually made up by two interconnecting rings so as to enable the collars to be placed tightly within the casing but so as to slide therein. Such collars, lying axially apart, are rigidly connected to the opposite ends of the outside bowed portions of the blade-like parts that lie spaced out around the outside of said collars. The outer bowed portion of such blades fit into the drill hole and are squeezed inwardly when so fitting, and thereby exert a centralizing force upon the casing within which the packer is introduced.

Other types of packers consist of many sets of both short and long arms which stretch outwards to become a protruding elbow, which elbow has a follower meant to touch the drill hole of the well around it.

However the centralizers of the kinds referred to above are employed to centralize equipment inside the casing, and are in direct touch with such casing by means of their bowed blades and arms, but do not protect the top of the inside casing, particularly when very sloping wells are being worked.

SUMMARY OF THE INVENTION

The present invention covers a centralizing device for packers, that prevents such packers from directly touching the top of the inside casing, particularly when steeply sloping wells are being worked, which is connected to the lower end of the packer. Said centralizing device consists of a sturdy tubular body with a set of fins in the middle thereof which project outwards from the diameter of the tubular body, and divide such tubular body. At its top, the tubular body is provided with a socket connection and at its bottom with a pin connection. The fins extend longitudinally and are equally apart, with each fin consisting of an elongated outer, central face portion, which is curved, and upper and lower inclined face portions which extend from respective ends of the outer, central face portion to the outer periphery of the tubular body.

Thus the centralizing device herewith described acts as a piece of equipment meant to protect the top of the inside casing and at the same time the packer itself, since the device when connected to the lower end of the packer and lowered into the production well, particularly wells that are steeply sloping, will touch the top of the inside casing first of all with the lower part of its tubular body. Since the lower part of the tubular body is a sturdy part of the device, it will not damage the top of the casing, at which, as lowering goes on in direct touch with the top and later direct touch with the lower straight parts of the fins and afterwards with its longer curved parts, and because the set of fins has a diameter that is substantially bigger than that of the aforesaid tubular body, the packer will be led and centralized within the inside casing without touching it in any way. Therefore, the packer will not be damaged in any way, not even as regards its rubber sealing parts.

The purposes and advantages peculiar to this invention will now be better seen from the detailed description to be provided with the aid of the drawings provided with this specification.

DESCRIPTION OF THE PREFFERRED EMBODIMENT

Figure 1:
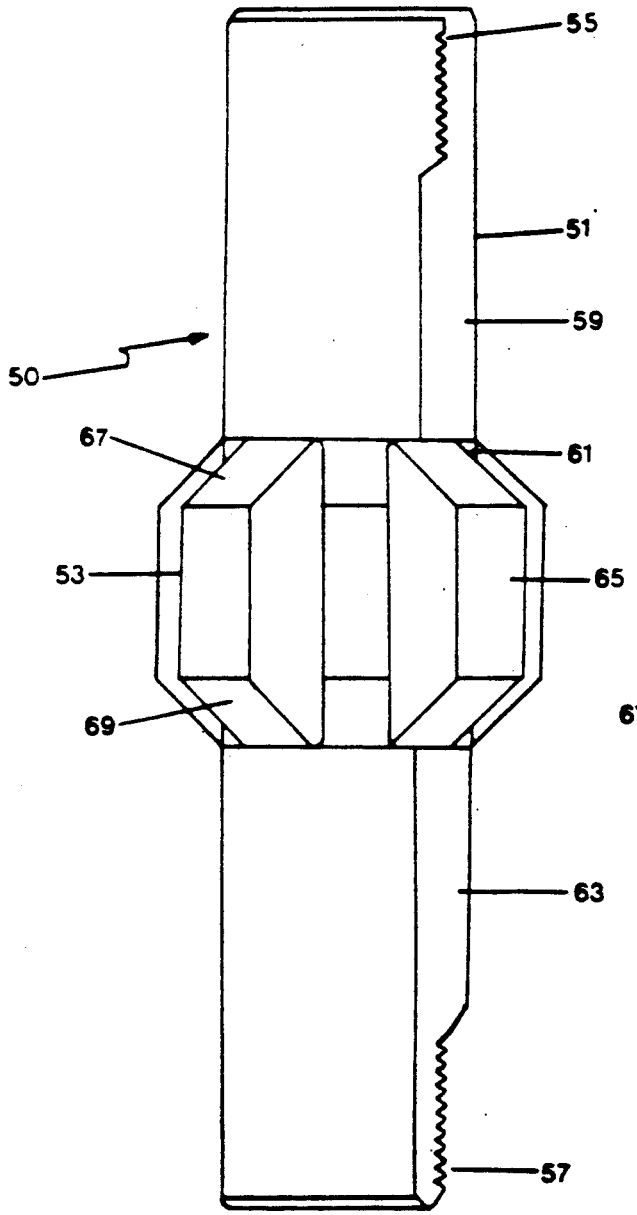
FIG. 1 is a view in side elevation of the packer centralizing device according to this invention.
Figure 2:
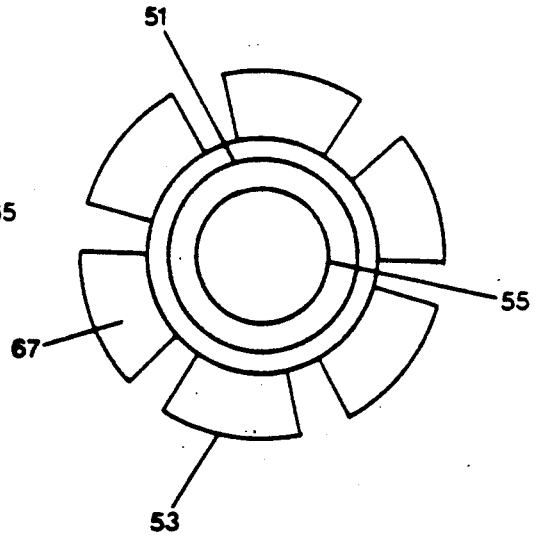
FIG. 2 is a top view of the device shown in FIG. 1.

As is seen in FIGS. 1 and 2, the packer centralizing device herewith invented, which has been given the reference number, 50, consists of a sturdy tubular body (51), which in its middle has a set of fins (53), projecting outward from the diameter of the aforesaid tubular body (51) and which divide such tubular body (51), which is provided above with a socket (55) and below with a connecting pin (57), into a top part (59), a middle part (61), which is surrounded by the set of fins (53), and a bottom part (63). Said fins (53) extend lengthwise and are equally spaced apart and consist of a curved central part (65), which is longer, the outside shape of which is the same as that of the tubular body (51), inclined flat face parts above (67), rising towards the top part (59) and inclined flat face portions below (69) falling towards the lower part (63) of the aforesaid tubular body (51).

Figure 3:
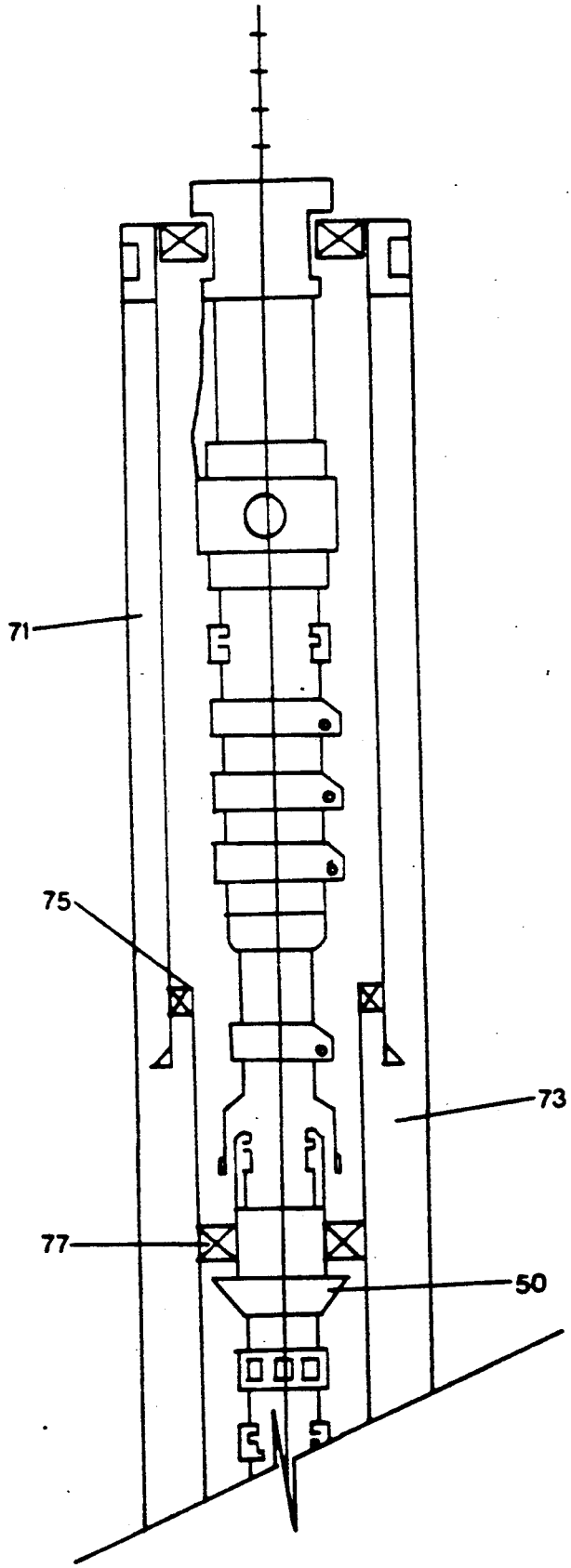
FIG. 3 is a diagram showing position of centralizing device for packers, under this invention.

In FIG. 3 which is a diagram of equipment used that is being lowered into a producing well, the outside casing (71) is seen to be concentric and below a casing (73) which stands about 2000 m down, provided with a top (75). As is to be seen from the Figure, the centralizing device (50) which is provided and connected to the lower end of the packer (77) prevents direct contact thereof, whether with the outside casing (71) or the inside casing (73), since at 2000 m down, said centralizing device (50) acts as a kind of sacrifice component, that is, it will be the first to be touched if any of the casings are hit, upon guiding and centralizing said packer into the inside casing of the producing well.

Figure 4:
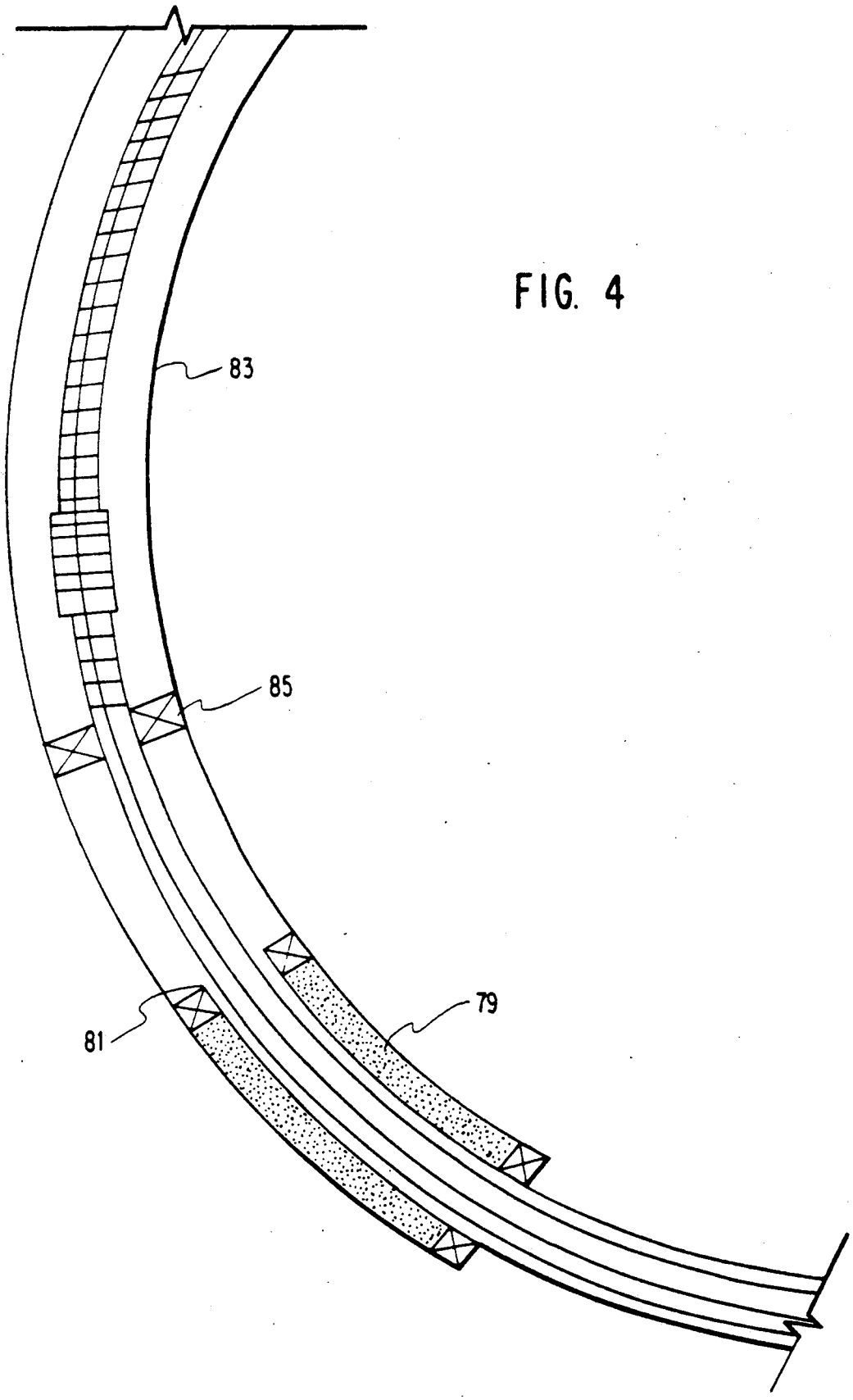
FIG. 4 is a diagram showing part of a steeply sloping producing well.

In FIG. 4, which shows a steeply inclined producing well, the centralizing device (not shown) acts as protection for both the inside casing (79), including the top thereof (81), and the outside casing itself (83), since the centralizing device (50), when connected to the lower end of the packer (85), and lowered into the producing well, will touch the top of inside casing (81) first of all with the bottom part (63) of its tubular body (51) which, since it is a sturdy part of the device, will not damage the top of the casing (81), at which, as lowering goes on in direct touch with the top and therefore direct touch taking place with lower straight portions (69) of fins (53), and afterwards with longer curved portions (65), and because the set of fins (53) has a diameter that is substantially bigger than that of said tubular body (51), the packer (85) will keep away from the top of the casing (81) and will be guided and centralized within the inside casing (79), thereby preventing it, and its rubber sealing parts, from suffering any damage.

I claim:

1. A packer centralizing device connected to a lower end of a packer so as to guide and centralize the packer into a producing well having a steep slope, the producing well including an outside casing and an inside casing disposed within the outside casing and having a top portion, said packer centralizing device comprising:

a) a rigid tubular body having an upper end and a lower end, both said upper and lower ends having connecting means, said upper end being connected to the lower end of the packer; and b) a plurality of fins projecting outwardly from an outer periphery of said tubular body at a middle portion thereof, said plurality of fins extending lengthwise of said tubular body and being equidistantly spaced apart around the outer periphery thereof, each of said fins having an elongated outer, central face portion which is curved for engagement with an inner surface of the outside and inside casings, respectively, and upper and lower inclined face portions which extend from respective ends of said elongated outer, central face portion to the outer periphery of said tubular body, whereby when said packer centralizing device and said packer are lowered into the producing well, the packer centralizing device protects the inside casing including the top portion, and the outside casing.

2. The packer centralizing device according to claim 1, wherein said connecting means for said upper end is a threaded socket.

3. The packer centralizing device according to claim 1, wherein said outer, central face portions of said plurality of fins together form a substantially circular periphery.

* * * * *